US005791413A

United States Patent [19]

Buzinsky

[11] Patent Number: 5,791,413

[45] Date of Patent: Aug. 11, 1998

[54] WIRELINE-SET, RETRIEVABLE PACKER WITH FLOW CONTROL PLUG AT THE TOP

[75] Inventor: Andrew A. Buzinsky, Calgary, Canada

[73] Assignee: Baker Hughes Incorporated, Houston, Tex.

[21] Appl. No.: 559,106

[22] Filed: Nov. 16, 1995

[51] Int. Cl.[6] ..... E21B 23/06

[52] U.S. Cl. ..... 166/123; 166/182

[58] Field of Search ..... 166/123, 181, 166/182

[56] References Cited

U.S. PATENT DOCUMENTS

| | | | |
|---|---|---|---|
| 4,185,689 | 1/1980 | Harris | 166/133 |
| 4,432,418 | 2/1984 | Mayland | 166/123 X |
| 4,532,989 | 8/1985 | Barker | 166/188 |
| 4,572,290 | 2/1986 | Clifton | 166/123 |
| 4,750,564 | 6/1988 | Pettigrew et al. | 166/236 X |
| 5,048,613 | 9/1991 | Shilling | 166/123 X |
| 5,253,705 | 10/1993 | Clary et al. | 166/123 |
| 5,613,560 | 3/1997 | Jelinski et al. | 166/387 |

*Primary Examiner*—William P. Neuder
*Attorney, Agent, or Firm*—Rosenblatt & Redano, P.C.

[57] ABSTRACT

A wireline-set retrievable packer with the flow plug on top is disclosed which uses a conventional setting tool. After setting the packer, picking up on the wireline allows the adapter assembly to disengage from the on/off seal nipple/packer so that the setting tool and adapter assembly can be removed.

13 Claims, 5 Drawing Sheets

WIRELINE-SET, RETRIEVABLE PACKER WITH FLOW CONTROL PLUG AT THE TOP

FIELD OF THE INVENTION

The field of the invention relates to devices for setting retrievable well packers with flow control devices.

BACKGROUND OF THE INVENTION

Conventional wireline-set retrievable packers typically utilize a rod running through the packer to the bottom, allowing the setting tool to transmit force to the bottom of the packer to set the packer. Because the rod must run through the "bore" of the packer, a flow control plug cannot be placed at the top of the packer, but must be placed below the packer in a seating nipple. Placement of the flow control plug below the packer creates problems when attempting to retrieve the plug on slick line or braided line, especially when debris has accumulated on top of the plug. If the plug is located at the top of the packer, any debris around the plug can be washed away prior to retrieval.

It is therefore an object of the invention to provide a wireline-set retrievable packer with a flow control plug at the top, allowing easy retrieval even in debris. It is a further object of the invention to provide such a wireline-set retrievable packer using as many existing components as possible, including standard on/off tool slick joints, with no modifications required.

A wireline (including slick line, e-line, etc.) set retrievable packer with the flow control plug at the top can be run into a live well without the use of a snubbing unit and without killing the well. However still another object of the invention is to provide an assembly which can be run on and set using coil tubing or rigid tubing.

Packers which are set in compression are often difficult to use at a shallow depth, where there is insufficient weight to set the packer. It is therefore yet another object of the invention to set the packer in tension rather than is compression, trapping the setting force at the top rather than at the bottom.

Finally, it is an object of the invention to provide an assembly with a relatively short overall length suitable for use in highly deviated wells.

SUMMARY OF THE INVENTION

A wireline-set retrievable packer with the flow plug on top is disclosed which uses a conventional setting tool. After setting the packer, picking up on the wireline allows the adapter assembly to disengage from the on/off seal nipple/packer so that the setting tool and adapter assembly can be removed.

DETAILED DESCRIPTION OF THE INVENTION

Figure 1A:
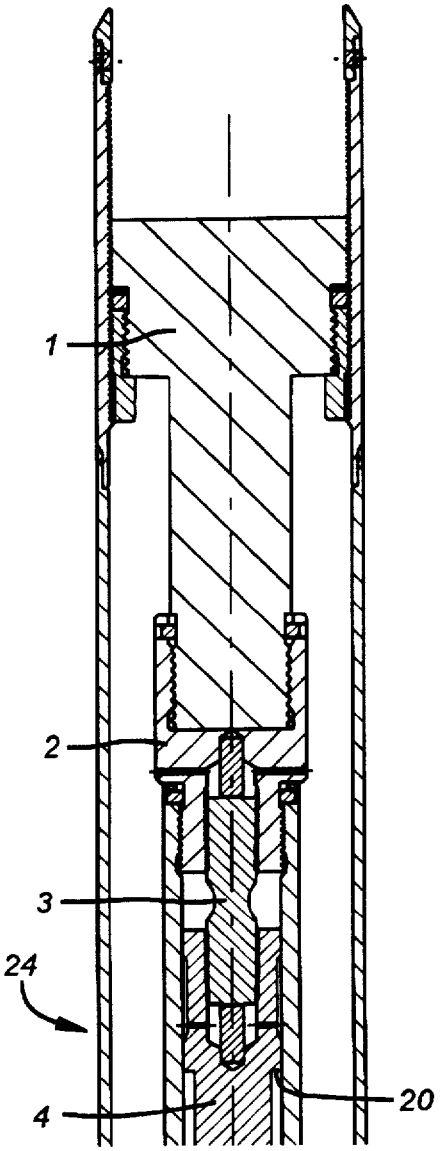
FIGS. 1*a–e* show one embodiment of the invention in the run-in position.
Figure 1B:
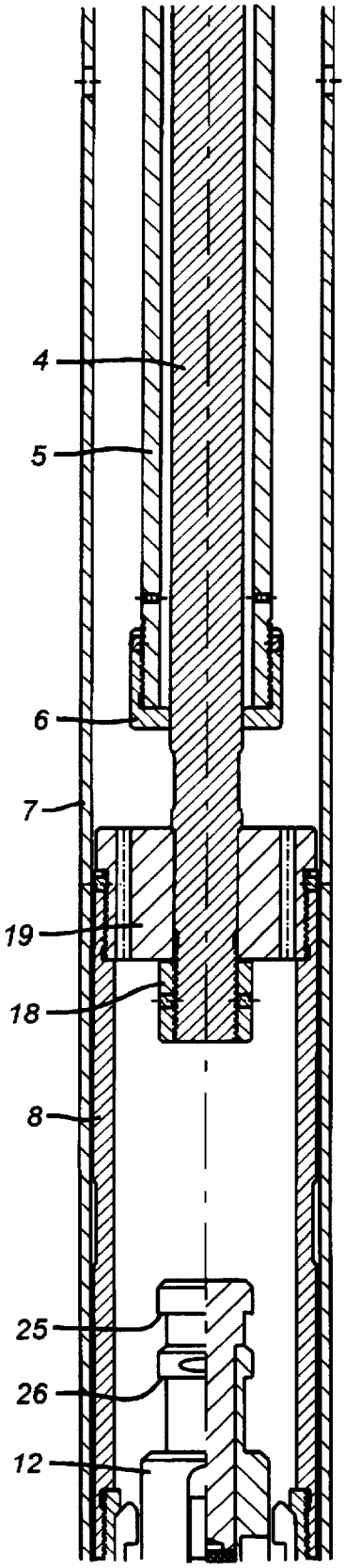
Figure 1C:
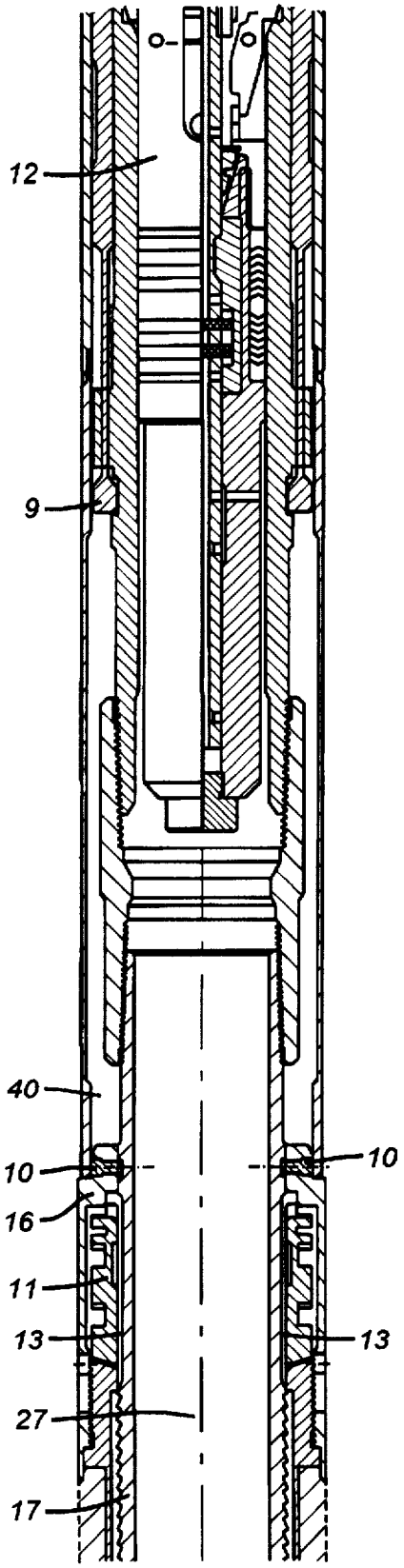
Figure 1D:
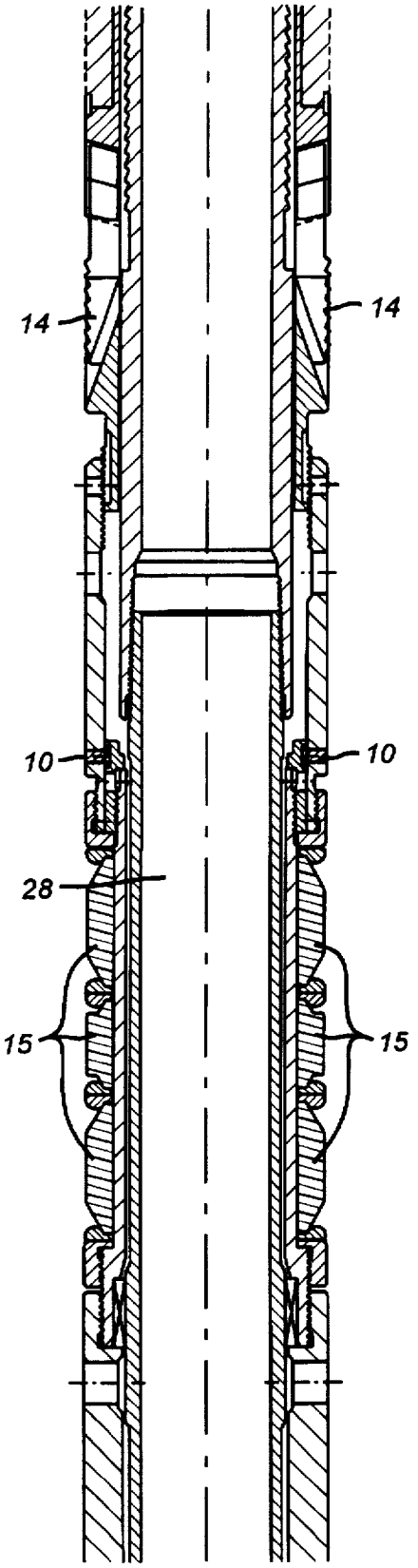
Figure 1E:
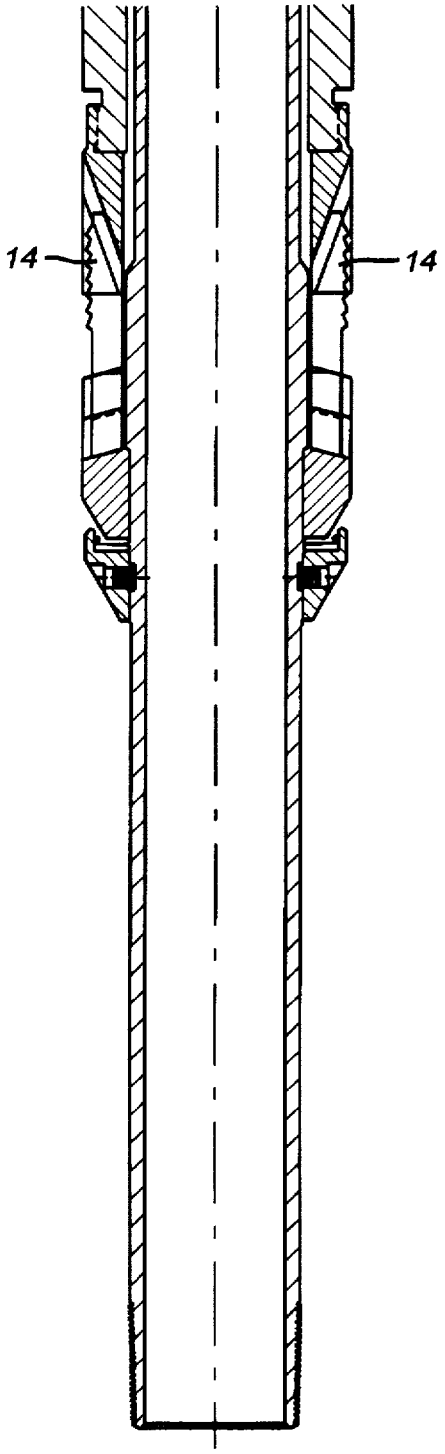

Referring to FIGS. 1*a–e*, one embodiment of the invention uses a conventional setting tool 1, an adapter assembly 24, a conventional flow plug 12, and a wireline-set packer 17. The setting tool may be a Baker Oil Tools E-4 WLPSA.

When run on coil tubing or threaded pipe, a Baker Oil Tools Model J hydraulic setting tool may be used. The flow control plug 12 is located in the on/off seal nipple 22 and seals the bore of the packer. The packer is prevented from being prematurely set by shear pins 10 which temporarily fix the control segment housing 16 to the mandrel 28. The adapter assembly 24 couples the setting tool to the packer 17/on/off seal nipple 22 by a collet mechanism 9 which is retained in place by a setting sleeve 7. The setting sleeve 7 attaches to the setting tool 1 and encloses the on/off seal nipple 22 and collet 9.

The adapter assembly 24 includes tension rod bushing 2, shear stud 3, tension rod 4, release sleeve 5, release sleeve cap 6, setting sleeve 7, adapter nut 19, tension rod nut 18, collet spacer sleeve 8, and release collet 9. Setting tool 1 is connected to one end of tension rod 4 via tension rod bushing 2 and shear stud 3. Tension rod bushing 2 also engages one end of release sleeve 5, which encircles tension rod 4 and is fitted on the other end with release sleeve cap 6. Tension rod 4 extends through release sleeve cap 6 and is held to adapter nut 19 by tension rod nut 18. Adapter nut 19 also engages collet spacer sleeve 8, which encompasses a portion of flow plug 12 and is attached to release collet 9.

Setting tool 1 also engages one end of setting sleeve 7, which encompasses flow plug 12 and collet spacer sleeve 8, and holds release collets 9 in a groove on flow plug 12. An interior portion of setting sleeve 7 below release collets 9 is provided with a recess 40. The other end of setting sleeve 7 abuts a shoulder 16 on the packer 17.

Figure 2A:
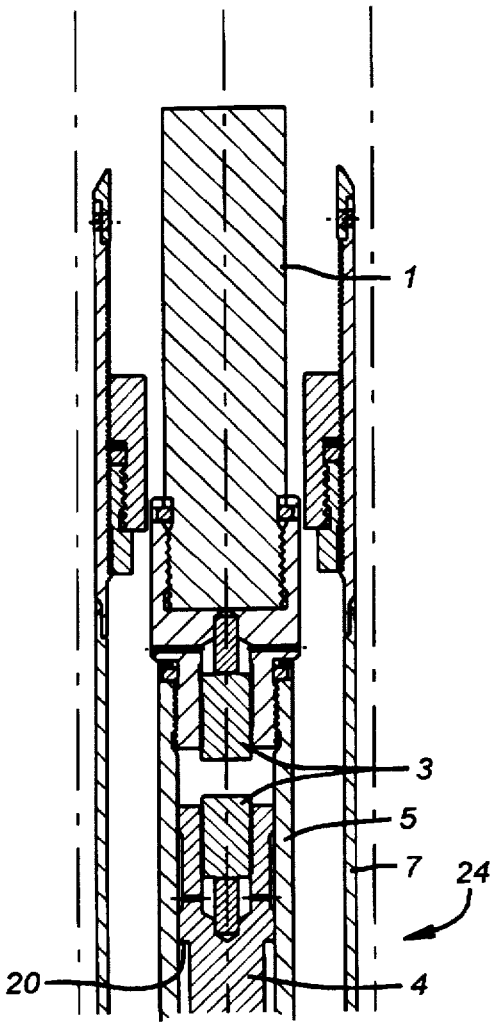
FIGS. 2*a–e* show the same embodiment of the invention in the set position with the adapter assembly partially ready to be disengaged from the flow plug/packer.
Figure 2B:
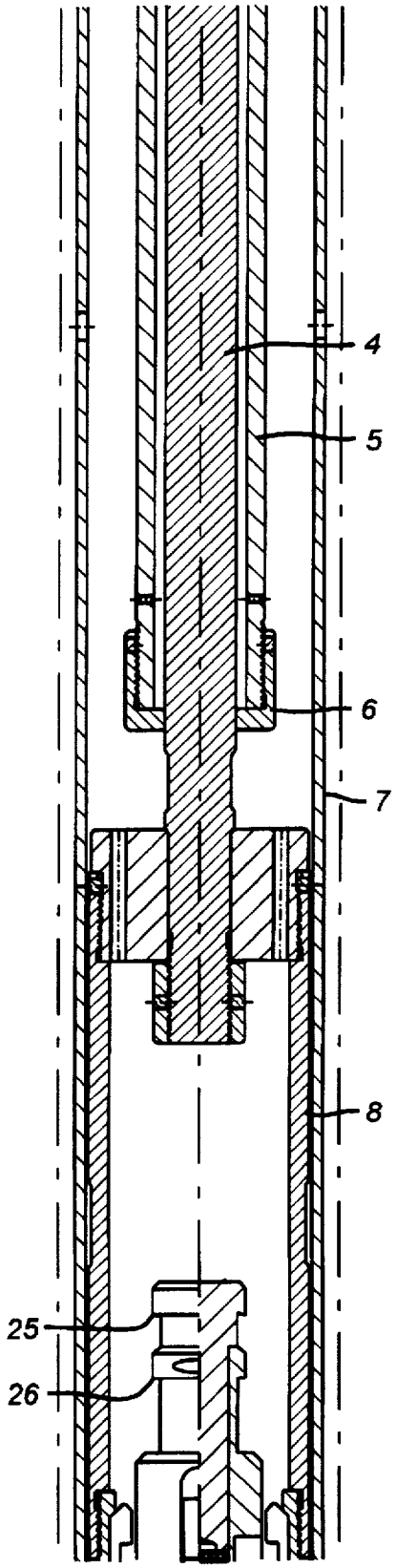
Figure 2C:
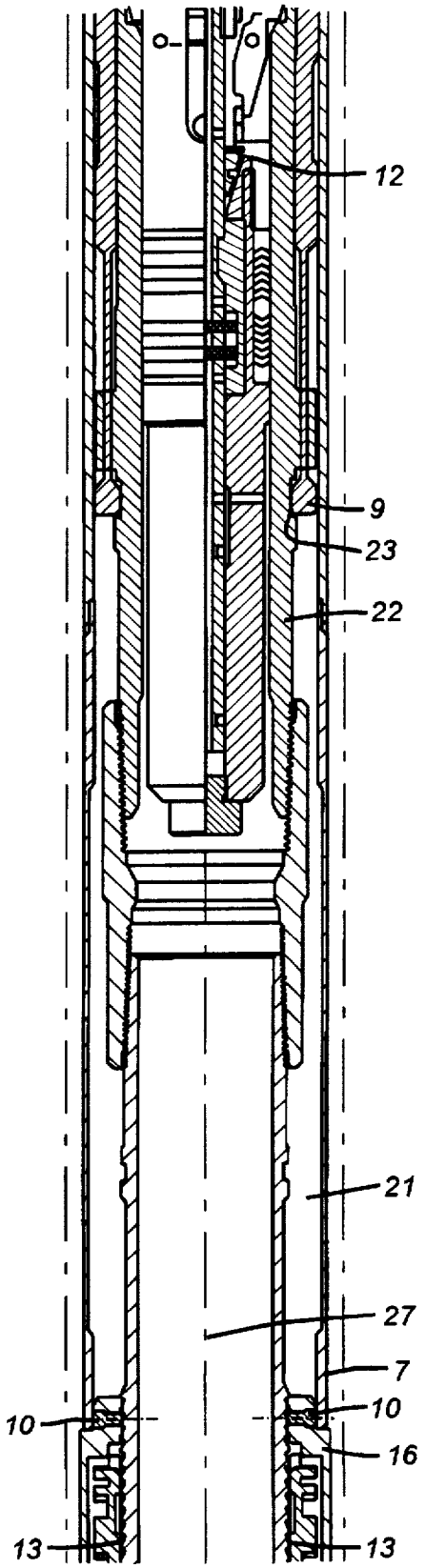
Figure 2D:
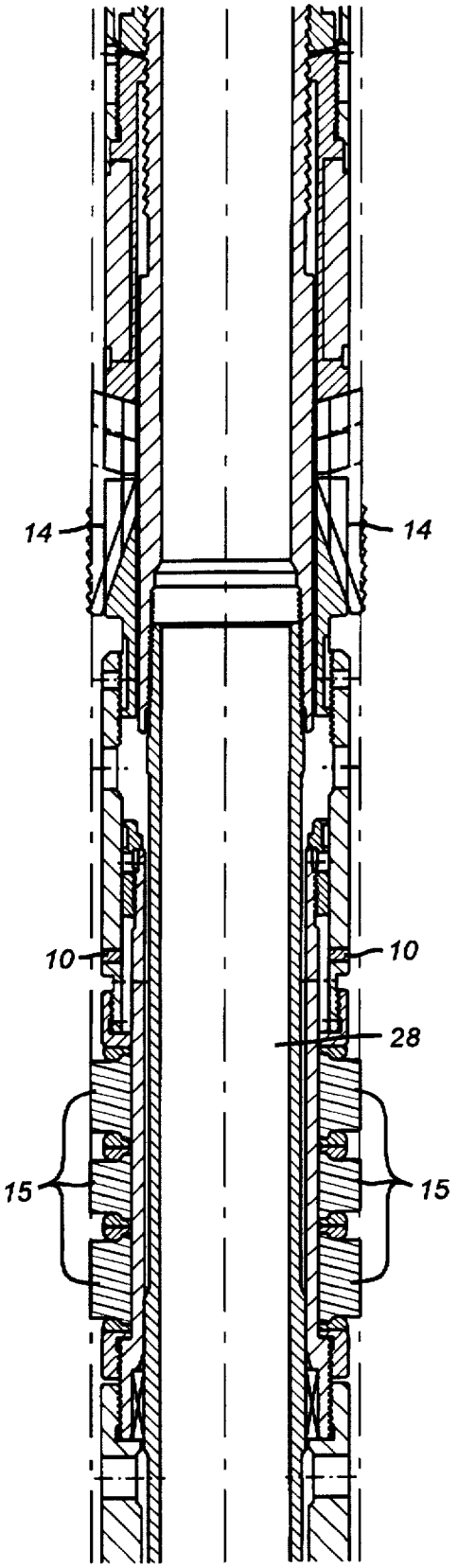
Figure 2E:
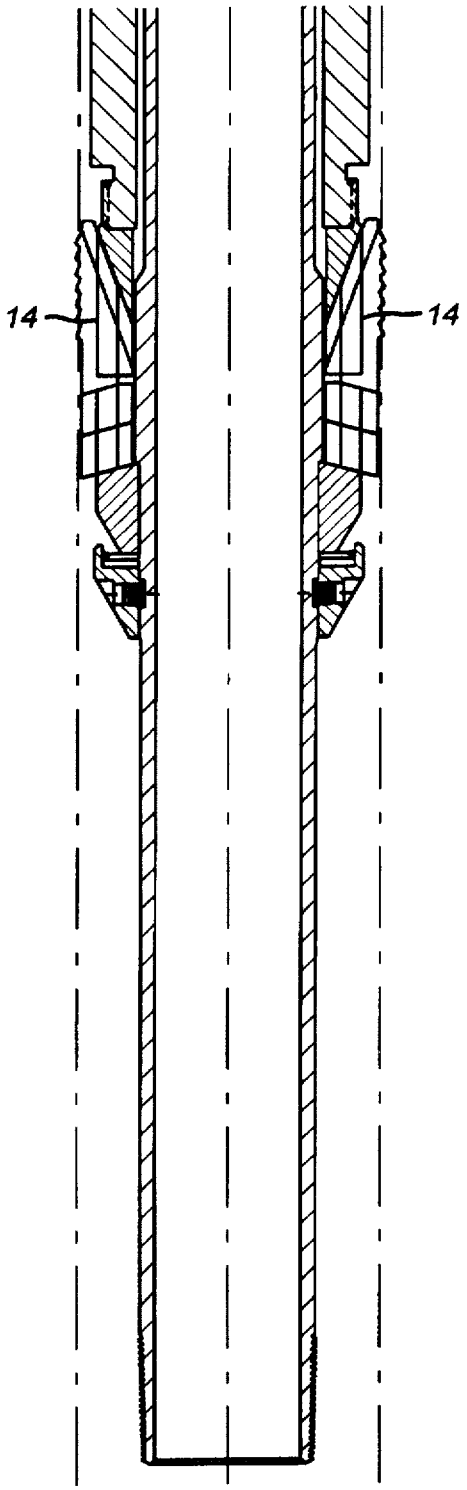

Referring to FIGS. 2*a–e*, actuation of setting tool 1 forces setting sleeve 7 down over the remainder of the adapter assembly and the flow plug 12. This downward movement of setting sleeve 7, acting on shoulder 16 on the ratchet housing of conventional wireline-set packer 17, causes shear pins 10 to shear, sets packer slips 14, and compresses packing elements 15. Ratchet mechanism 13 maintains the packer in a set position. The setting tool 1 continues to provide force into the packer until it reaches the force equal to the strength of the shear stud 3 at which time the stud separates.

Once the packer has been set, picking up on the wireline with a predetermined force causes the setting tool 1, tension rod bushing 2, release sleeve 5, and release sleeve cap 6 to move upwards until the release sleeve cap 6 bottoms out on shoulder 20 of the tension rod 4. This movement of the wireline will also move setting sleeve 7 upward with respect to release collet 9, positioning the interior recessed portion 21 of setting sleeve 7 over release collet 9. Release collet 9 is thereby freed to disengage from grooves 23 on seal nipple 22, allowing the setting tool 1 and adapter assembly to be removed by the wireline.

Among the various advantages of the present invention is the ease with which flow control device 12 can be retrieved. A conventional flow plug includes a first fishing neck 25 which may be used to retrieve the core of the flow plug, allowing pressure to equalize above and below the plug 12. Second fishing neck 26 on flow plug 12 may then be used to retrieve the remainder of the flow plug. When flow plug 12 is attached below packer 17, these operations must be performed through the bore 27 of packer 17, where space is considerably more limited than above packer 17. Placing the flow plug on top also facilitates washing away debris from around the fishing necks 25 and 26 on flow plug 12.

The foregoing disclosure and description of the invention are illustrative and explanatory thereof, and various changes in the size, shape and materials, as well as in the details of the illustrated construction, may be made without departing from the spirit of the invention.

What is claimed is:

1. A packer assembly, comprising:

a packer having a top and a bore therethrough;

a flow control device accessible from the top of said packer and removable mounted in said bore;

a setting tool; and an adapter assembly operatively connecting said setting tool to said packer to allow setting said packer while leaving said flow control device accessible for subsequent selective removal from the top of said packer.

2. The packer assembly of claim 1 wherein said flow control device is wireline retrievable.

3. The packer assembly of claim 2 wherein said flow control device is accessible to washing by circulation.

4. A packer assembly, comprising:

a packer having a top;

a flow control device accessible from the top of said packer;

a setting tool; and an adapter assembly operatively connecting said setting tool to said packer;

said adapter assembly further comprises a setting sleeve having first and second ends, said first end attached to said setting tool and said second end abutting a portion of said packer, said setting sleeve encompassing at least a portion of said flow control device.

5. A packer assembly comprising:

a packer having a top;

a flow control device accessible from the top of said packer;

a setting tool;

an adapter assembly operatively connecting said setting tool to said packer;

said adapter assembly further comprises a setting sleeve having first and second ends, said first end attached to said setting tool and said second end abutting a portion of said packer, said setting sleeve encompassing at least a portion of said flow control device; and said flow control device is attached to said packer by a seal nipple.

6. The packer assembly of claim 5 wherein said seal nipple has a circumferential groove.

7. The packer assembly of claim 5 wherein said adapter assembly further comprises:

a collet; and a collet spacer sleeve having first and second ends, said first end attached to said setting tool and said second end attached to said collet;

said setting sleeve encompassing said collet spacer sleeve and said collet and holding said collet engaged in said groove.

8. The packer assembly of claim 5 wherein said setting sleeve has an interior recessed portion.

9. The packer assembly of claim 8 wherein said adapter assembly further comprises:

a release sleeve having first and second ends, said first end attached to said setting tool;

a release sleeve cap having an aperture and attached to said second end of said release sleeve; and a tension rod having first and second ends, said first end attached to said collet spacer sleeve and said second end extending through said aperture in said release sleeve cap so that said release sleeve encompasses at least a portion of said tension rod, said second end free to move within said release sleeve.

10. The packer assembly of claim 9 wherein said tension rod further comprises a shoulder at said second end, said shoulder preventing said second end of said tension rod from passing through said aperture in said release sleeve cap.

11. The packer assembly of claim 10 wherein said adapter assembly further comprises a shear stud initially attaching said second end of said tension rod to said setting tool, said shear stud adapted to separate under a predetermined tension.

12. A packer assembly comprising:

a packer having a top;

a flow control device accessible the top of said packer;

a setting tool;

an adapter assembly operatively connecting said setting tool to said packer;

said flow control device is wireline retrievable; and said flow control device comprises a core having a fishing neck for removal of said core from said flow control device.

13. The packer assembly of claim 12 wherein said packer further comprises an axial bore so that removal of said core allows equalization of pressure differentials surrounding said packer.

* * * * *